US006695596B2

(12) United States Patent
Oh et al.

(10) Patent No.: US 6,695,596 B2
(45) Date of Patent: Feb. 24, 2004

(54) SUCTION GAS VALVE APPARATUS OF RECIPROCATING COMPRESSOR

(75) Inventors: Won-Sik Oh, Seoul (KR); Jung-Sik Park, Seoul (KR)

(73) Assignee: LG Electronics Inc., Seoul (KR)

( * ) Notice: Subject to any disclaimer, the term of this patent is extended or adjusted under 35 U.S.C. 154(b) by 73 days.

(21) Appl. No.: 09/958,742

(22) PCT Filed: Feb. 17, 2001

(86) PCT No.: PCT/KR01/00239

§ 371 (c)(1),
(2), (4) Date: Oct. 16, 2001

(87) PCT Pub. No.: WO01/61192

PCT Pub. Date: Aug. 23, 2001

(65) Prior Publication Data

US 2002/0134436 A1 Sep. 26, 2002

(30) Foreign Application Priority Data

Feb. 17, 2000 (KR) ..... 2000-7555
Nov. 15, 2000 (KR) ..... 2000-67700

(51) Int. Cl.[7] ..... F04B 53/12
(52) U.S. Cl. ..... 417/547; 417/549; 417/552
(58) Field of Search ..... 417/547, 549, 417/552, 553, 555.1

(56) References Cited

U.S. PATENT DOCUMENTS

| | | | | | |
|---|---|---|---|---|---|
| 95,613 | A | * | 10/1869 | Somes | 417/549 |
| 307,862 | A | * | 11/1884 | Loth | 417/552 |
| 349,830 | A | * | 9/1886 | Wheeler | 417/552 |
| 366,368 | A | * | 7/1887 | Bennett et al. | 222/133 |
| 370,896 | A | * | 10/1887 | Schuehle | 417/549 |
| 525,541 | A | * | 9/1894 | Garrison | 417/552 |
| 543,446 | A | * | 7/1895 | Johnson | 417/549 |
| 592,235 | A | * | 10/1897 | Campbell | 417/552 |
| 636,459 | A | * | 11/1899 | Sharpneck | 417/552 |
| 825,973 | A | * | 7/1906 | Miles | 417/549 |
| 878,483 | A | * | 2/1908 | Miles | 417/552 |
| 882,099 | A | * | 3/1908 | Daffrin | 417/464 |
| 898,659 | A | * | 9/1908 | Kuehl | 417/259 |
| 921,155 | A | * | 5/1909 | Perez | 417/549 |
| 1,001,301 | A | * | 8/1911 | Rathmell | 417/552 |
| 1,053,525 | A | * | 2/1913 | Meklensek | 417/547 |

(List continued on next page.)

FOREIGN PATENT DOCUMENTS

| | | |
|---|---|---|
| JP | 1983-2481 | 1/1983 |
| JP | 1983-85377 | 5/1983 |
| JP | 1983-14683 | 8/1983 |
| JP | 03-260382 | 11/1991 |
| JP | 05-039781 | 2/1993 |
| JP | 05-312151 | 11/1993 |

*Primary Examiner*—George L. Walton
(74) *Attorney, Agent, or Firm*—Birch, Stewart, Kolasch & Birch, LLP

(57) ABSTRACT

In a suction valve apparatus of a reciprocating compressor including a piston having a gas passage at which gas flows inside its body portion, a valve seat formed at an end of a piston body to open the gas passage and a step face formed so as to have a thickness inward from the valve seat and have a plurality of gas through holes and a mounting through hole, and a valve cone having a detachable coupling portion formed extendely from a cone portion corresponded to the valve seat of the piston and inserted into the mounting through hole of the step face of the piston so as to be movable, a re-expansion loss can be reduced by minimizing a dead volume of a suction gas valve, an efficiency of a reciprocating compressor can improve by reducing a heat transmission loss by sucking refrigerant gas through the plurality of gas through holes of the step face from the gas passage. In addition, the number of parts can be reduced and its structure can be simplified, accordingly it is advantageous to a mass-production as well as heightening the assembly productivity.

8 Claims, 6 Drawing Sheets

U.S. PATENT DOCUMENTS 1,109,154 A * 9/1914 Thomas ..... 417/552
1,272,568 A * 7/1918 Swan et al. ..... 417/549
1,463,628 A * 7/1923 Mumford ..... 417/552
1,490,141 A * 4/1924 Stoms ..... 417/552
1,528,086 A * 3/1925 Scovel, Jr. ..... 417/552
1,641,501 A * 9/1927 Post et al. ..... 417/552
2,078,347 A * 4/1937 Shepherd et al. ..... 417/552
3,175,758 A * 3/1965 Dirk ..... 417/552

* cited by examiner

SUCTION GAS VALVE APPARATUS OF RECIPROCATING COMPRESSOR

This application is the national phase under 35 U.S.C. §371 of PCT International Application No. PCT/KR01/00239 which has an International filing date of Feb. 17, 2001, which designated the United States of America and was published in English.

TECHNICAL FIELD

The present invention relates to a suction gas valve apparatus of a reciprocating compressor, and in particular to a suction gas valve apparatus of a reciprocating compressor which is capable of promoting an efficiency of a refrigerant by minimizing a heat transmission between a suction gas valve apparatus and the refrigerant by improving respondency of a suction gas valve and simplifying its structure.

BACKGROUND ART

In general, a compressor compresses a fluid such as refrigerant gas, etc. A compressor is constructed with a motor part generating a driving force and a compression part compressing a fluid by being transmitted the driving force. A shape of the compression part is various, but in general a piston inserted into a cylinder is transmitted the driving force from the motor part, sucks a fluid, compresses the fluid and discharges it while performing a linear reciprocating motion inside the cylinder.

FIG. 1 is a sectional view illustrating a piston and a suction gas valve apparatus of a compressor installed to the piston in accordance with the prior art. As depicted in FIG. 1, in a suction gas valve apparatus of a compressor in accordance with the prior art, a piston 10 is inserted into a cylinder 1. Herein, the piston 10 inserted into the cylinder 1 is constructed with a cylindrical body unit 11 having a certain diameter and a certain length, a valve mounting portion K formed at a certain end of the cylindrical body unit 11 in order to be mounted with a suction valve body 20 and a hole H having a certain diameter and a certain length and formed at the other end of the cylindrical body unit 11.

In the cylindrical body unit 11, a mounting groove 12 having a certain diameter and a length is formed at an end of the cylindrical body unit 11, and a multistage mounting protrusion portion N is protrusively formed from a bottom surface of the mounting groove 12 in a upward direction. By the mounting groove 12 formed at the end of the cylindrical body unit 11, a ring-shaped rim portion 13 having a certain length and a width in a circumference direction of the piston 10 is formed, and the inner end of the rim portion 13 forms a first valve seat 14 declined to a center of the piston 10. A plurality of suction holes 15 connected to the mounting groove 12 are formed at the rim portion 13.

And, the mounting protrusion portion N includes a fist circular protrusion 16 upwardly extended-formed from the bottom surface of the mounting groove 12 so as to be smaller than an outer diameter of the mounting groove 12 and have an outer diameter same as an inner diameter of the mounting groove 12, and a second circular protrusion 17 formed at the upper surface of the first circular protrusion 16 so as to have a smaller diameter than the outer diameter of the first circular protrusion 16 and have a certain height.

And, a through hole 18 is formed at the center portion of the first and the second circular protrusions 16, 17 so as to connect to the hole H formed at the opposite side of the mounting protrusion portion N. Herein, the height of the first and the second circular protrusions 16, 17 is lower than the height of the rim portion 13. And, the rim portion 13 of the first circular protrusion 16 is projected so as to have a sloping side declined to the center of the piston 10 and forms a second valve seat 19 with the upper surface of the first circular protrusion 16.

And, a suction valve body 20 installed inside the valve mounting portion K of the piston 10 has a certain height and a conic shape with a plane upper surface. The outer circumference of the suction valve body 20 is formed so as to be stepped, the upper outer circumference having a bigger outer diameter consists a first contact surface 21, the lower outer circumference having a smaller outer diameter consists a second contact surface 22. A plane bottom surface having a small area consists a third contact surface 23.

And, a through hole 24 is formed at the center portion of the suction valve body 20, a first insertion groove 25 is formed at the center portion of the third contact surface 23 so as to have an inner diameter and a height corresponded to the outer diameter and the height of the second circular protrusion 17 of the valve mounting portion K of the piston 10, and a second insertion groove 26 is formed at the center portion of the bottom surface of the suction valve body 20 so as to have a certain inner diameter and a depth. The inner diameter of the first insertion groove 25 is larger than the inner diameter of the second insertion groove 26, the center lines of the first and the second insertion grooves 25, 26 are placed at the line same as the center line of the through hole 24.

Hereinafter, installing the suction valve body 20 to the piston 10 will now be described in detail.

First, a first insertion groove 25 of the suction valve body 20 is inserted into the second circular protrusion 17 of the valve mounting portion K. Herein, the part of the third contact surface 23 and the second contact surface 22 of the suction valve body 20 is contacted to the second valve seat 19, and the first contact surface 21 is contacted to the first valve seat 14. In addition, the through hole 24 of the suction valve body 20 is combined to the through hole 18 of the piston 10 by corresponding their center lines.

And, a combining guide rod 30 having a certain length and head units 31, 31' at both ends is combined inside the through hole 18 of the suction valve body 20 and the through hole 18 of the piston 10. The head unit 31 combined to the end of the combining guide rod 30 is placed inside the second insertion groove 26 of the suction valve body 20, the height of the head unit 31 is lower than the height of the second insertion groove 26 and the outer diameter of the head unit 31 is smaller than the inner diameter of the second insertion groove 26. In addition, the head unit 31' combined to the other end of the combining guide rod 30 is placed inside the hole H formed at the lower end of the cylindrical body unit 11. Accordingly, the suction valve body 20 can move up and down although the combining guide rod 30 is combined to.

Hereinafter, the operation of the suction gas valve apparatus of the compressor in accordance with the prior art will now be described.

The suction valve body 20 is open and shut by a pressure difference between up and down of the suction valve body 20 and an inertia force due to a motion of the piston 10. First, as depicted in FIG. 2, when the piston 10 transmitted the driving force moves from a upper dead center to a bottom dead center, namely, in an "a" direction, gas flows into a suction hole 15 by a suction force, and the gas is sucked into the cylinder 1 through the first contact surface 21 of the mounting groove 12 and the first valve seat 14 of the suction valve body 20 while the suction valve body 20 moves in "a" direction opposite to the piston moving direction according to the combining guide rod 30.

And, when the piston 10 moves from a lower dead center to a upper dead center, namely, in a "b" direction, suctioning the gas into the suction hole 15 is stopped, the first contact surface 21 of the suction valve body is mounted on the first valve seat 14, the lower portion of the second contact surface 22 and the third contact surface 23 are contacted to the second valve seat 19 and are sealed while the suction valve body 20 moves to a lower portion according to the combining guide rod 30 by a pressure, and the gas flowed into the cylinder 1 is compressed By performing the above-mentioned process, the gas flows into the cylinder 1.

However, in the above-mentioned structure in accordance with the prior art, because the suction valve body 20 is open and shut only by the pressure difference between up and down of the suction valve body 20 and the inertia force by the motion of the piston 10, the respondency of the suction valve body 20 is not good.

In addition, in the above-mentioned structure in accordance with the prior art, because the combining guide rod 30 penetrates the suction valve body 20 and the piston 10, in order to prevent leakage of refrigerant due to the penetration, a sealing member is inserted between the second valve seat 19 and the second and the third contact surfaces 22, 23 of the suction valve body 20, and between the head unit 31 of the combining guide rod 30 and the piston 10, etc., accordingly its structure is complicated and its processing is difficult.

And, because the combining guide rod 30 is inserted into the second insertion groove 26 of the suction valve body 20, a dead volume always exists, accordingly a re-expansion loss occurs.

TECHNICAL GIST OF THE PRESENT INVENTION

It is an object of the present invention to provide a suction gas valve apparatus of a reciprocating compressor which is capable of improving an efficiency of a refrigerant by simplifying its structure.

It is another object of the present invention to provide a suction gas valve apparatus of a reciprocating compressor which is capable of improving respondency of a suction valve body and minimizing a dead volume.

In order to achieve the above-mentioned objects, there is provided a suction gas valve apparatus of a reciprocating compressor in accordance with the present invention including a piston having a gas passage at which gas flows inside its cylindrical body unit, a valve seat formed at an end of the piston body unit to open the gas passage and a step face formed so as to have a thickness inward from the valve seat and have a plurality of gas through holes and a mounting through hole, and a valve cone having a detachable coupling portion formed extendedly from a cone portion corresponded to the valve seat of the piston and inserted into the mounting through hole of the step face of the piston so as to be movable.

DETAILED DESCRIPTION OF THE INVENTION

Hereinafter, a first embodiment of a suction gas valve apparatus of a reciprocating compressor in accordance with the present invention will now be described with reference to accompanying drawings.

Figure 1:
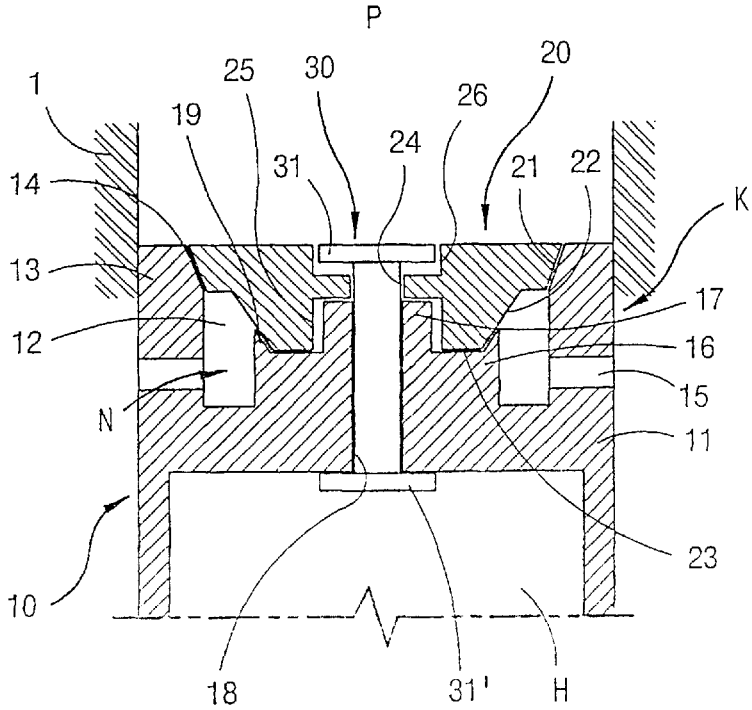
FIG.1 PRIOR ART
FIG. 1 is a sectional view illustrating a suction gas valve apparatus of a reciprocating compressor in accordance with the prior art.
Figure 2:
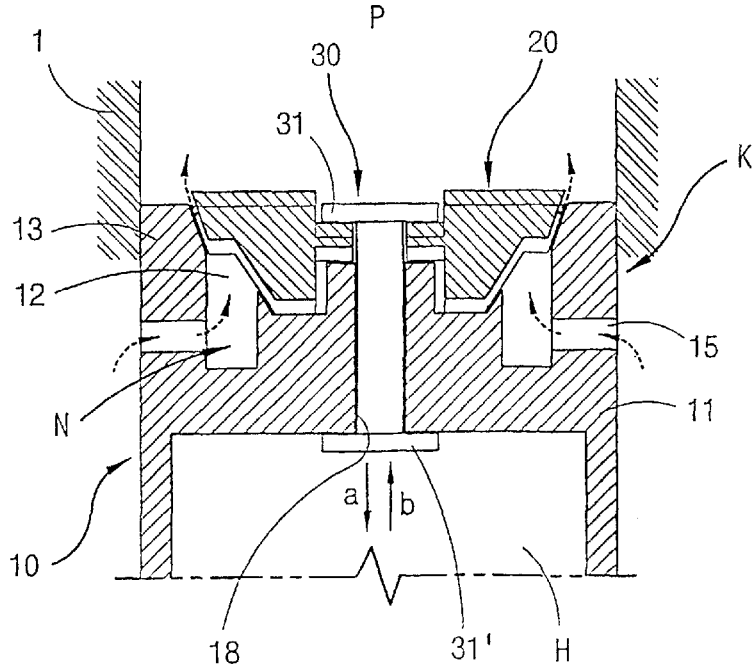
FIG.2 PRIOR ART
FIG. 2 is a sectional view illustrating an operating state of the suction gas valve apparatus of the reciprocating compressor in accordance with the prior art.
Figure 3:
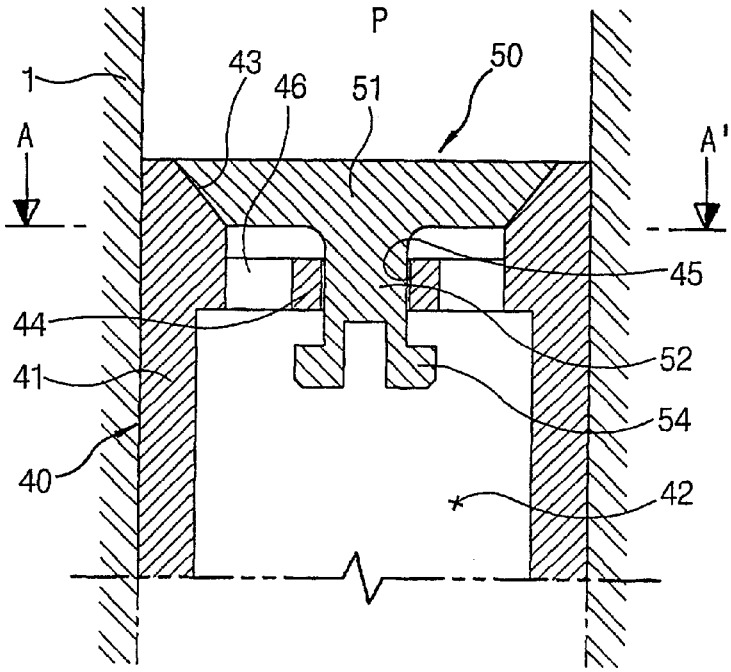
FIG. 3 is a sectional view illustrating a first embodiment of a suction gas valve apparatus of a reciprocating compressor in accordance with the present invention.
Figure 4:
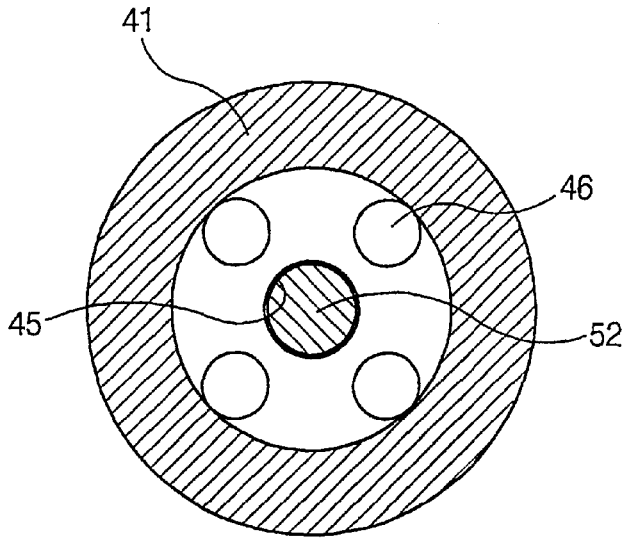
FIG. 4 is a sectional view taken along line A–A' in FIG. 3.

FIG. 3 is a sectional view illustrating a first embodiment of a suction gas valve apparatus of a reciprocating compressor in accordance with the present invention. As depicted in FIG. 3, a first embodiment of a suction gas valve apparatus of a reciprocating compressor in accordance with the present invention includes a piston 40 having a gas passage 42 at which gas flows inside its cylindrical body unit 41, a valve seat 43 formed at an end of the cylindrical body unit 41 to open the gas passage 42.

And, in the first embodiment of the suction gas valve apparatus of the reciprocating compressor, a step face 44 is formed so as to have a certain thickness inward from the valve seat 43, a mounting through hole 45 is formed at the center portion of the step face 44, and a plurality of gas through holes 46 are formed at the outer circumference of the mounting through hole 45.

In addition, the first embodiment of the suction gas valve apparatus of the reciprocating compressor includes a valve cone 50 having a detachable coupling portion 52 formed extendedly from a cone portion 51 corresponded to the valve seat 43 of the piston 40 and inserted into the mounting through hole 45 of the step face 44 of the piston 40 so as to be movable. The cone portion 51 is formed so to have a conic shape with a plane head portion in order to shut the gas passage 42 and have the outer circumference same as a slant and a width of the valve seat 43.

And, the detachable coupling portion 52 has a section corresponded to the mounting through hole 45 of the piston 40 and a certain length, a slit groove 53 is formed at the inner end of the detachable coupling portion 52, a bridging protrusion portion 54 is formed at the outer end of the detachable coupling portion 52, in operation of the suction valve apparatus of the reciprocating compressor, the bridging protrusion portion 54 is caught in the step face 44 formed at the piston 40, accordingly the movement of the valve cone 50 is restricted.

In the valve cone 50, the detachable coupling portion 52 is inserted into the mounting through hole 45 of the step face 44 so as to be movable while the cone portion 51 is in contact with the valve seat 43 of the piston 40.

It will now be described in detail.

When the detachable coupling portion 52 is inserted into the mounting through hole 45 of the step face 44, because the slit groove 53 becomes narrower, the section of the detachable coupling portion 52 decreases, after the detachable coupling portion 52 is inserted into the mounting through hole 45 of the step face 44, because the slit groove 53 is restored to the original state, the bridging protrusion portion 54 is caught by the rim of the mounting through hole 45, accordingly a breakaway of the detachable coupling portion 52 can be prevented while moving.

Figure 7:
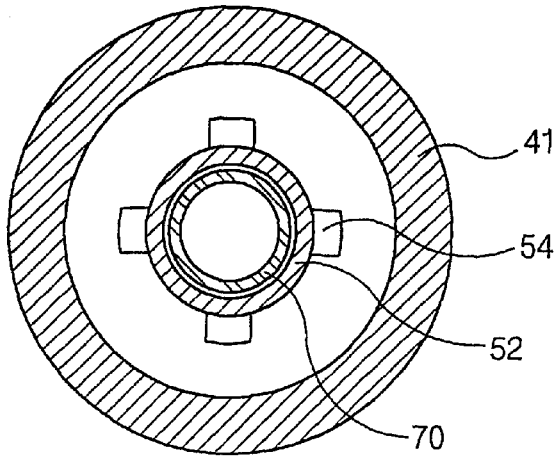
FIG. 7 is a sectional view taken along line B–B' in FIG. 6.

In addition, as depicted in FIG. 7, it is advisable to form the bridging protrusion portion 54 so as to be divided into several portions by forming a plurality of slit grooves 53 crossed each other.

Figure 5:
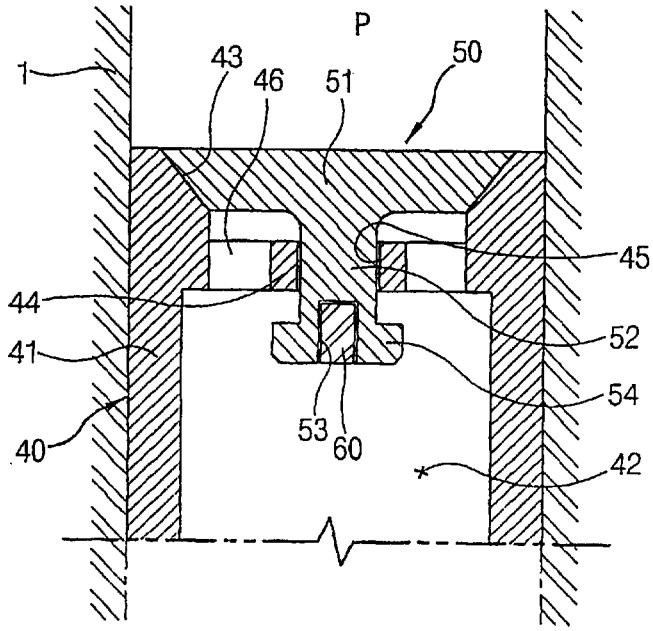
FIG. 5 is a sectional view illustrating another example of the first embodiment of the suction gas valve apparatus of the reciprocating compressor in accordance with the present invention.

As depicted in FIG. 5, in another example of the first embodiment of the suction gas valve apparatus of the reciprocating compressor, after combining the valve cone 50 to the step face 44 of the piston 40, a filling member 60 is combined to the slit groove 53 of the detachable coupling portion 52 formed at the valve cone 50 in order to prevent the slit groove 53 from breaking away from the step face 44 due to heat distortion in operating.

Figure 6:
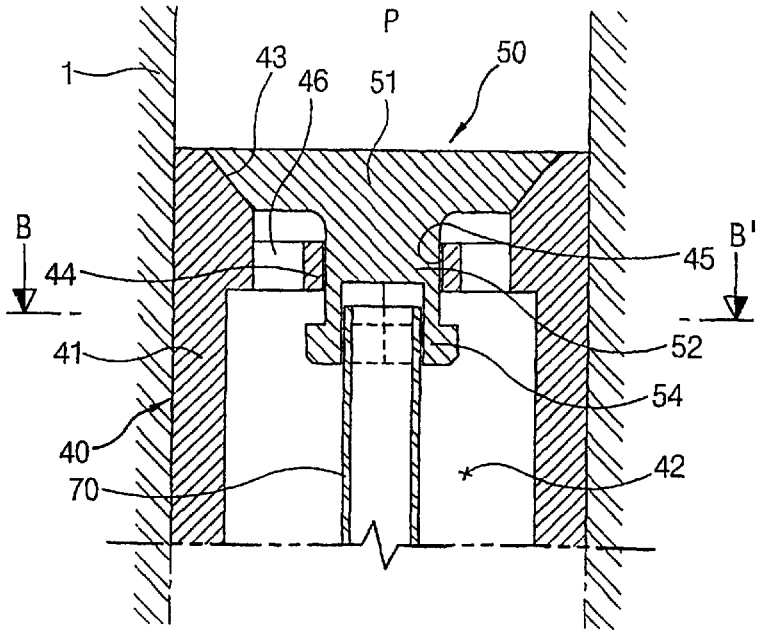
FIG. 6 is a sectional view illustrating still another example of the first embodiment of the suction gas valve apparatus of the reciprocating compressor in accordance with the present invention.

As depicted in FIG. 6, in still another example of the first embodiment of the suction gas valve apparatus of the reciprocating compressor, a suction pipe 70 having a certain length is inserted into the gas passage 42 of the piston 40 so as to place its end inside the slit groove 53 of the detachable coupling portion 52. The suction pipe 70 not only guides suction of refrigerant gas but also prevents heat distortion of the bridging protrusion portion 54, accordingly a breakaway of the valve cone 50 due to a breakaway of the bridging protrusion portion 54 from the mounting through hole 45 can be prevented.

Hereinafter, the operation of the first embodiment of the suction gas valve apparatus of the reciprocating compressor in accordance with the present invention will now be described.

Figure 8:
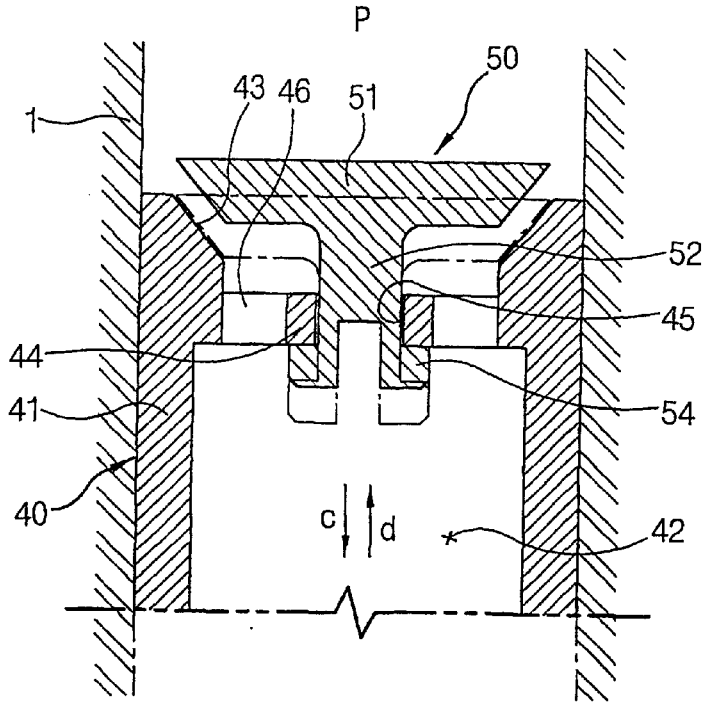
FIG. 8 is a sectional view illustrating an operating state of the first embodiment of the suction gas valve apparatus of the reciprocating compressor in accordance with the present invention.

First, the piston 40 being transmitted the driving force from the motion part performs a linear reciprocating motion inside the cylinder 1. Herein, as depicted in FIG. 8, when the piston 40 moves from a upper dead center to a lower dead center, namely, in a c direction (suction process), coolant gas flows through the gas passage 42 and the gas through hole 46 formed at the step face 44 of the piston 40 by a pressure difference between the both ends of the valve cone 50 and an inertia force, the coolant gas flows continually through a gap formed between the valve seat 43 of the piston 40 and the outer circumference of the valve cone 50 during the suction process. Herein, because the bridging protrusion portion 54 of the detachable coupling portion 52 is caught in the rim of the mounting through hole 45 of the step face 44, the moving extent of the valve cone 50 is restricted.

And, when the piston 40 moves from a lower dead center to a upper dead center, namely, in a "d" direction (compression process), the valve cone 50 is mounted on the valve seat 43 of the piston 40 by the pressure difference between the both ends of the valve cone 50, influx of the refrigerant gas sucked into the cylinder 1 through the gas passage 42 of the piston 40 and the valve seat 43 is stopped, and the refrigerant gas sucked into the cylinder 1 is compressed. And, the compressed gas is discharged through an additional discharge valve (not shown) when the pressure is not less than a set pressure.

The above-mentioned process is performed continually by the piston 40 performing repeatedly the linear reciprocating motion inside the cylinder 1 by being transmitted the driving force from the motion part.

Hereinafter, a second embodiment of a suction gas valve apparatus of a reciprocating compressor in accordance with the present invention will now be described with reference to accompanying drawings.

Figure 9:
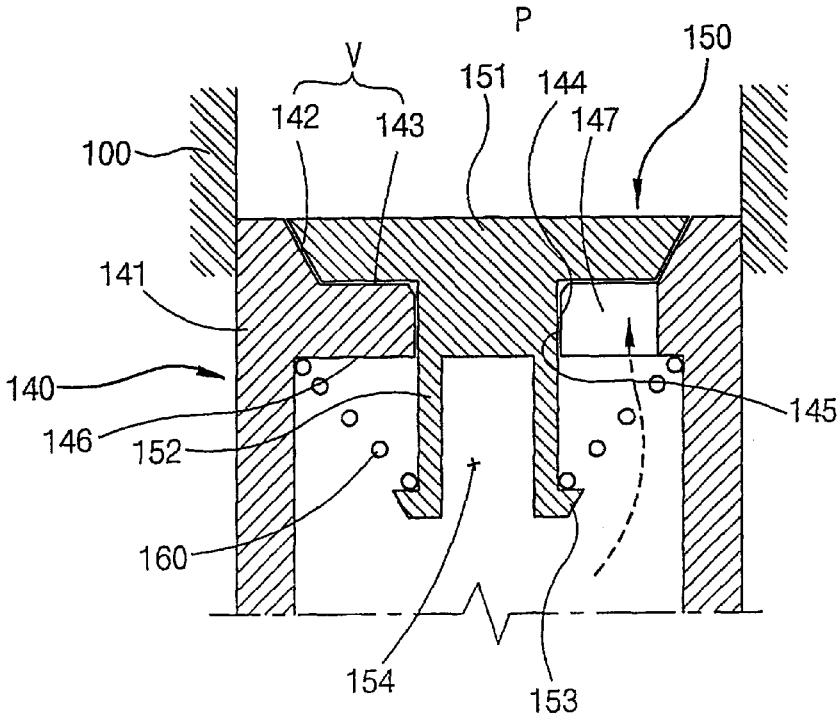
FIG. 9 is a sectional view illustrating a second embodiment of a suction gas valve apparatus of a reciprocating compressor in accordance with the present invention.
Figure 10:
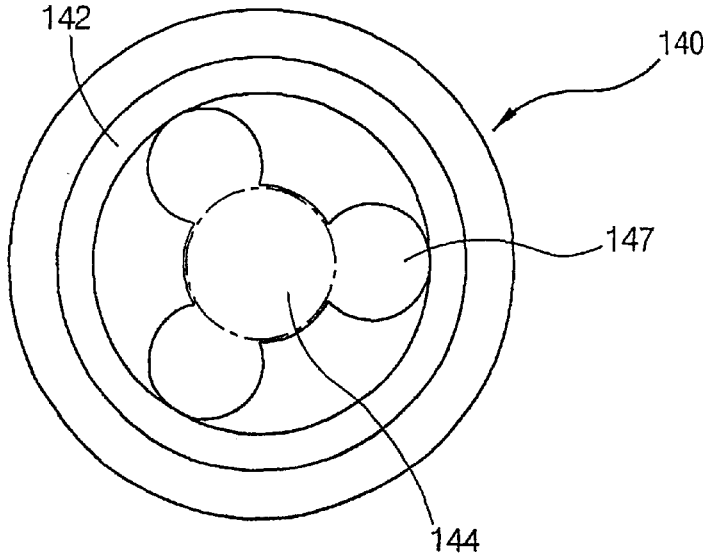
FIG. 10 is a plan view illustrating the second embodiment of the suction gas valve apparatus of the reciprocating compressor in accordance with the present invention.

As depicted in FIGS. 9 and 10, in a second embodiment of a suction gas valve apparatus of a reciprocating compressor in accordance with the present invention, a cylindrical piston 140 corresponded to an inner diameter of a cylinder 100 is inserted into the cylinder 100 constructing a compression part, and a valve seat V is formed at an end of a body unit 141 of the piston 140. A slope contact surface 142 is formed at the valve seat V in intaglio, and a plane contact surface 143 having a certain area is formed next to the slope contact surface 142 so as to be parallel to a section. A mounting through hole 144 is formed at the plane contact surface 143 constructing the valve seat V in order to insert a valve cone 150, a gas passage 145 having a bigger inner diameter than the inner diameter of the mounting through hole 144 is formed at the mounting through hole 144, and a step face 146 is formed by the inner diameter difference between the mounting through hole 144 and the plane contact surface 143. And, a plurality of gas through holes 147 are formed at a cross wall formed by the step face 146 and the plane contact surface 143, herein it is advisable to form the plurality of gas through holes 147 so as to contact and connect to the mounting through hole 144.

A cone portion 151 is formed at the outer circumference of the valve cone 150 so as to be corresponded to the shape of the valve seat V, and a bridging protrusion portion 153 is formed at the end of a detachable coupling portion 152 extended a certain length from the cone portion 151 and inserted into the mounting through hole 144. In addition, a cylindrical groove 154 is formed inside the detachable coupling portion 152 so as to have a certain depth and an inner diameter.

In addition, it is advisable to form the bridging protrusion portion 153 so as to be divided into several ends by forming a plurality of slots at its outer circumference.

And, an elastic member 160 constructed with a cone-shaped coil spring is installed between the step face 146 and the bridging protrusion portion 153.

Hereinafter, the operation of the second embodiment of the suction gas valve apparatus of the reciprocating compressor in accordance with the present invention will now be described.

Figure 11:
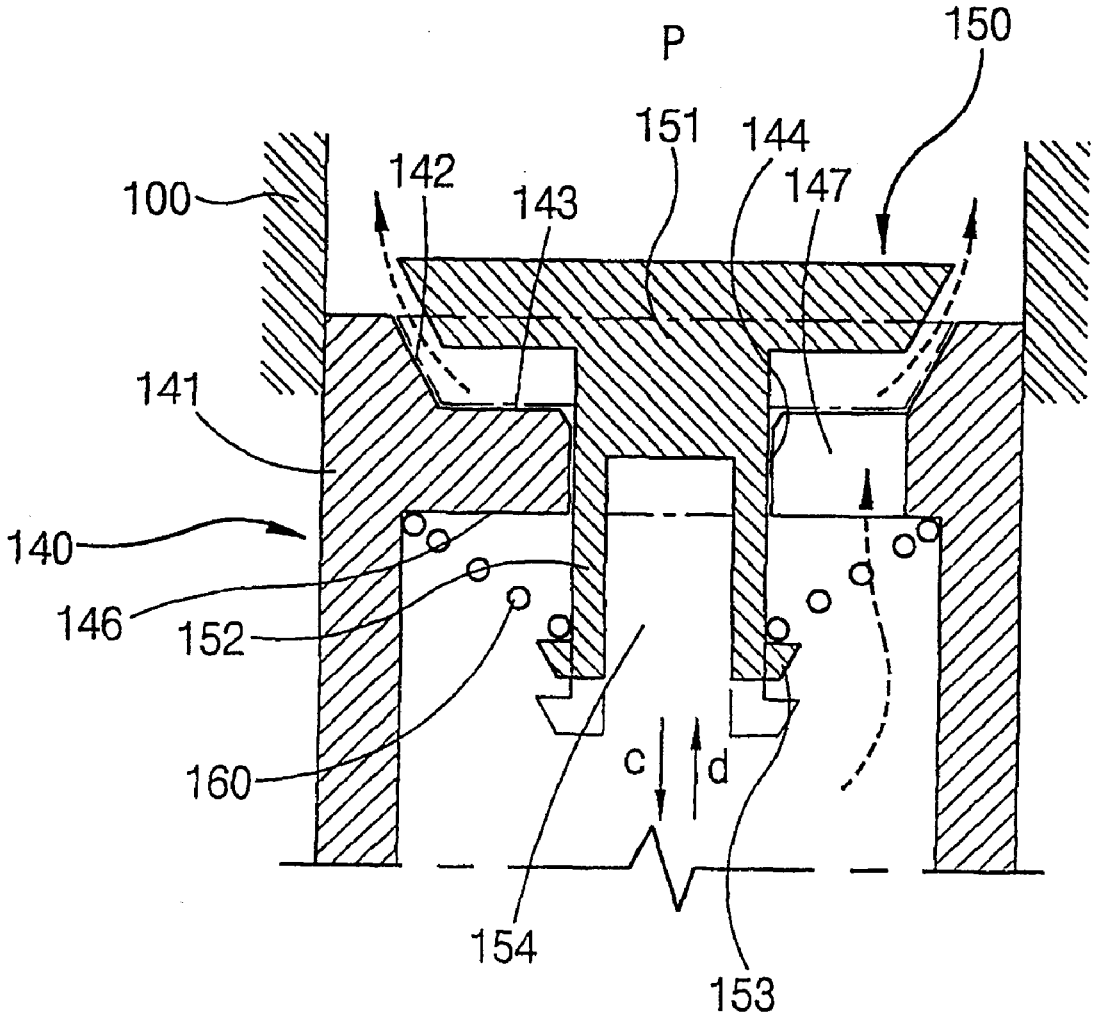
FIG. 11 is a sectional view illustrating an operating state of the second embodiment of the suction gas valve apparatus of the reciprocating compressor in accordance with the present invention.

First, the piston 140 is inserted into the cylinder 100, the piston 140 is connected to the motion part generating the driving force. And, in the valve cone 150, the cone portion is mounted on the valve seat V of the piston 140 and the detachable coupling portion 152 is inserted into the mounting through hole 144 of the piston 140. And, the end (long diameter side) of the cone-shaped coil spring as the elastic member 160 is supported by the step face 146, the other end (short diameter side) of the cone-shaped coil spring as the elastic member 160 is supported by the bridging protrusion portion 153 of the valve cone 150. By the elasticity of the elastic member 160, in stopping of the suction gas valve apparatus the cone portion 151 of the valve cone 150 is tightly contacted to the valve seat V of the piston 140. In this state, as depicted in FIG. 11, when the piston 140 moves from a upper dead center to a lower dead center, namely, in a "c" direction (suction process), there is a gap between the cone portion 151 of the valve cone 150, the valve seat V of the piston 140 and the outer circumference of the valve cone 150 by the pressure difference between the both ends of the valve cone 150 and the inertia force, the refrigerant gas is continually sucked inside a compressing area P through the gap for the suction process. Herein, the compressing force is acted on the elastic member 160.

And, when the piston 140 moves from a lower dead center to a upper dead center, namely, in a "d" direction (compression process), the cone portion 151 is mounted on the valve seat V of the piston 140 by the pressure difference between the both ends of the valve cone 150 and the restoring force of the elastic member 160 and shuts the gas through hole 147 formed at the piston 140, accordingly the influx of the gas into the compressing area P is shut off and the gas sucked into the compressing area P is compressed. Herein, the elastic member 160 is in a free state.

INDUSTRIAL APPLICABILITY

In a suction gas valve apparatus of a reciprocating compressor in accordance with the present invention, because a surface of a valve cone contacted to a compressing area inside a cylinder is plane without having an additional groove or a junction portion when the valve cone is mounted on a valve seat, a dead volume can be minimized. In addition, because refrigerant gas is sucked through a gas through hole of a step face from the inner space of a piston, a heat transmission from the surroundings is minimized, accordingly an efficiency of a reciprocating compressor can be improved by reducing a re-expansion loss.

In addition, a number of parts is reduced by constructing a suction gas valve apparatus of a reciprocating compressor with a valve cone and a piston mounted to the valve cone, its structure is simplified and parts fabrication is facilitated. Accordingly, the assembly process is simplified and it is advantageous to a mass-production as well as heightening the assembly productivity.

In addition, because a valve cone is open and shut by not only a pressure difference between the both ends of the valve cone but also an elasticity of a coil spring, it is easy to open and shut the valve cone and respondency of the valve cone can be improved.

In addition, because an elastic member is interposed between a step face and a bridging protrusion portion, an impact noise occurred in contacting of the bridging protrusion portion to the step portion in operation of a reciprocating compressor can be reduced by a buffer effect of the elastic member, accordingly a reliability of the compressor can be improved.

What is claimed is:

1. A suction gas valve apparatus of a reciprocating compressor, comprising:

a piston having a gas passage at which gas flows inside its cylindrical body unit, a valve seat formed at an end of the cylindrical body unit to open the gas passage and a step face formed so as to have a thickness inward from the valve seat and have a plurality of gas through holes and a mounting through hole; and a valve cone having a detachable coupling portion formed extendedly from a cone portion which is corresponded to the valve seat of the piston and inserted into the mounting through hole of the step face of the piston so as to be movable, wherein a cylindrical groove is formed at an inward portion of an end of the detachable coupling portion.

2. The apparatus of claim 1, wherein the detachable coupling portion of the valve cone is formed so as to have a section and a length corresponded to the mounting through hole of the piston, and a bridging protrusion portion is outwardly formed from the outer surface of the detachable coupling portion.

3. The apparatus of claim 1, further comprising:

an elastic member placed between the valve cone and the piston in order to elastically support a movement of the valve cone.

4. The apparatus of claim 3, wherein the elastic member is a cone-shaped coil spring.

5. A suction gas valve apparatus of a reciprocating compressor comprising:

a piston having a gas passage at which gas flows inside its cylindrical body unit, a valve seat formed at an end of the cylindrical body unit to open the gas passage and a step face formed so as to have a thickness inward from the valve seat and have a plurality of gas through holes and a mounting through hole; and a valve cone having a detachable coupling portion formed extendedly from a cone portion which is corresponded to the valve seat of the piston and inserted into the mounting through hole of the step face of the piston so as to be movable, wherein a cylindrical groove is formed at an inward portion of an end of the detachable coupling portion and a filling member formed to be corresponded to the cylindrical groove is inserted into the cylindrical groove of the detachable coupling portion.

6. A suction gas valve apparatus of a reciprocating compressor comprising:

a piston having a gas passage at which gas flows inside its cylindrical body unit, a valve seat formed at an end of the cylindrical body unit to open the gas passage and a step face formed so as to have a thickness inward from the valve seat and have a plurality of gas through holes and a mounting through hole; and a valve cone having a detachable coupling portion formed extendedly from a cone portion which is corresponded to the valve seat of the piston and inserted into the mounting through hole of the step face of the piston so as to be movable, wherein a cylindrical groove is formed at an inward portion of an end of the detachable coupling portion and a suction pipe is inserted into the gas passage of the piston, and an end of the suction pipe is placed inside the cylindrical groove.

7. A suction gas valve apparatus of a reciprocating compressor comprising:

a piston having a gas passage at which gas flows inside its cylindrical body unit, a valve seat formed at an end of the cylindrical body unit to open the gas passage and a step face formed so as to have a thickness inward from the valve seat and have a plurality of gas through holes and a mounting through hole; and a valve cone having a detachable coupling portion formed extendedly from a cone portion which is corresponded to the valve seat of the piston and inserted into the mounting through hole of the step face of the piston so as to be movable, wherein a cylindrical groove having a certain depth and an inner diameter is formed inside the detachable coupling portion and is connected to a space around the outer circumference of a suction gas valve.

8. A suction gas valve apparatus of a reciprocating compressor comprising:

a piston having a gas passage at which gas flows inside its cylindrical body unit, a valve seat formed at an end of the cylindrical body unit to open the gas passage and a step face formed so as to have a thickness inward from the valve seat and have a plurality of gas through holes and a mounting through hole; and a valve cone having a detachable coupling portion formed extendedly from a cone portion which is corresponded to the valve seat of the piston and inserted into the mounting through hole of the step face of the piston so as to be movable, wherein the plurality of gas through holes of the step face are formed so as to contact and connect to the mounting through hole.

* * * * *